United States Patent [19]

Hamamoto et al.

[11] Patent Number: 4,627,224

[45] Date of Patent: Dec. 9, 1986

[54] METHOD AND AN APPARATUS FOR PACKING A SEMISOLID COMPOUND IN BAGS

[75] Inventors: Hideki Hamamoto, Himeji; Tsutomu Fujita, Suita; Takuzo Mori, Takatsuki, all of Japan

[73] Assignees: Nihon Spindle Seizo Kabushiki Kaisha; Showa Rekisei Kogyo Kabushiki Kaisha, both of Hyogo, Japan

[21] Appl. No.: 628,630

[22] Filed: Jul. 6, 1984

[30] Foreign Application Priority Data

Mar. 30, 1984 [JP] Japan ..... 59-64680

[51] Int. Cl.[4] ..... B65B 3/28

[52] U.S. Cl. ..... 53/502; 53/127; 53/282; 141/125

[58] Field of Search ..... 53/127, 282, 292, 294, 53/375, 382, 385, 440, 502, 562, 368, 384, 386, 439, 469, 479, 503; 141/125–127, 255, 264, 280; 222/58, 377, 388

[56] References Cited

U.S. PATENT DOCUMENTS

| | | | |
|---|---|---|---|
| 1,866,439 | 7/1932 | Wood et al. | 141/255 X |
| 2,766,104 | 10/1956 | Gilmore | 222/58 X |
| 2,777,480 | 1/1957 | Linda | 53/440 X |
| 3,340,679 | 9/1967 | Johnson | 53/385 |
| 3,421,220 | 1/1969 | Stanga | 53/440 |
| 3,469,363 | 9/1969 | Berckmoes | 53/440 |
| 3,501,318 | 3/1970 | Wilson | 53/127 X |
| 3,564,808 | 2/1971 | Kent | 53/440 |
| 3,693,369 | 9/1972 | Horsewell | 53/440 X |
| 3,987,602 | 10/1976 | Stahl | 53/385 X |
| 4,118,916 | 10/1978 | Fresnel | 53/292 |
| 4,368,608 | 1/1983 | Ray | 53/440 |

FOREIGN PATENT DOCUMENTS

| | | | |
|---|---|---|---|
| 2652010 | 5/1978 | Fed. Rep. of Germany | 53/469 |

*Primary Examiner*—John Sipos
*Assistant Examiner*—Steven P. Weihrouch
*Attorney, Agent, or Firm*—Wenderoth, Lind & Ponack

[57] ABSTRACT

A method of packing a semisolid compound into a bag comprising the steps of precooling a high temperature semisolid compound to such a temperature at which it can maintain the desired viscosity, filling said precooled semisolid compound into a packing bag made of synthetic resin while cooling its outer surface with water, heat-sealing an opening part of the bag, putting the bag in a water tank for cooling, removing the cooled bag and transporting it, and an apparatus for carrying out the above-described method.

10 Claims, 27 Drawing Figures

METHOD AND AN APPARATUS FOR PACKING A SEMISOLID COMPOUND IN BAGS

BACKGROUND OF THE INVENTION

1. Field of the invention:

This invention relates to a method and an apparatus for packing a compound which is in a solid or a semifluid state at a normal temperature (hereinafter referred to as a semisolid compound), such as asphalt, tar and pitch, in bags made of thermoplastic high polymer material film.

2. Prior art:

Asphalt, for example, is usually transported as it is packed in drums but each asphalt drum weighs some 200 kgs. and it is inconvenient to handle such weighty drums. Furthermore, it requires labor to handle empty drums after the contents are used. In this connection, a method of packing such materials in paper bags or the like has been suggested (for example, Japanese Patent Application Publication Gazette No. 41-22177), but it is troublesome to unpack each paper bag when the contents are used.

The inventors previously suggested a method of packing asphalt in a polyethylene resin bag (about 20 kg. in each bag) having a softening point lower than asphalt in a fluid state while cooling the bag, so that such bags of comparatively light weight can be transported easily and the bags themselves can be melted directly into asphalt, when asphalt is used, with resultant weight increasing and reinforcing effect on asphalt (Japanese Patent Application No. 58-1004).

The present invention is an improvement on the above method and has for its object to provide a novel method of packing and an apparatus therefor, by which a series of packing operations can be carried out effectively and compactly.

BRIEF EXPLANATION OF THE DRAWINGS

The nature and advantage of the present invention will be understood more clearly from the following description made with reference to the accompanying drawings, in which.

DETAILED EXPLANATION OF THE INVENTION

The drawings show an example of packing a semisolid compound (hereinafter referred to as a filter), asphalt in this case, in a packing bag of synthetic resin (for example, made by the inflation method using mixed resin of vinylacetate copolymer and polyethylene of low density).

Figure 1:
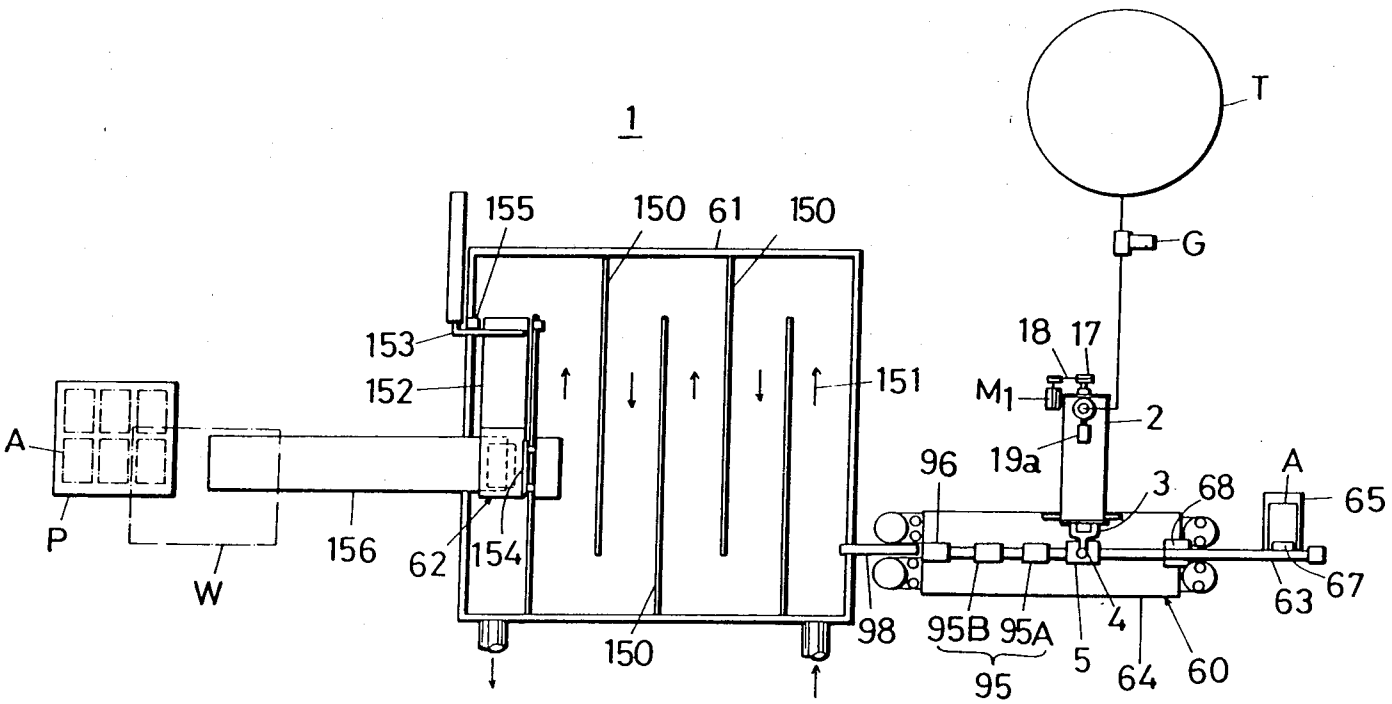
FIG. 1 is a schematic plan view of the whole of an apparatus for packing a semisolid compound according to the present invention.

Referring first to FIG. 1, T denotes a storing tank for molten asphalt of high temperature. A packing device 1 according to the present invention is provided with a precooling device 2 which receives and precools asphalt (filler) supplied from the storing tank T by means of a gear pump G, a weighing and delivering device 3 which weighs and sends out the precooled filler and a filling valve 4 for filling the filler in a packing bag A.

Figure 2:
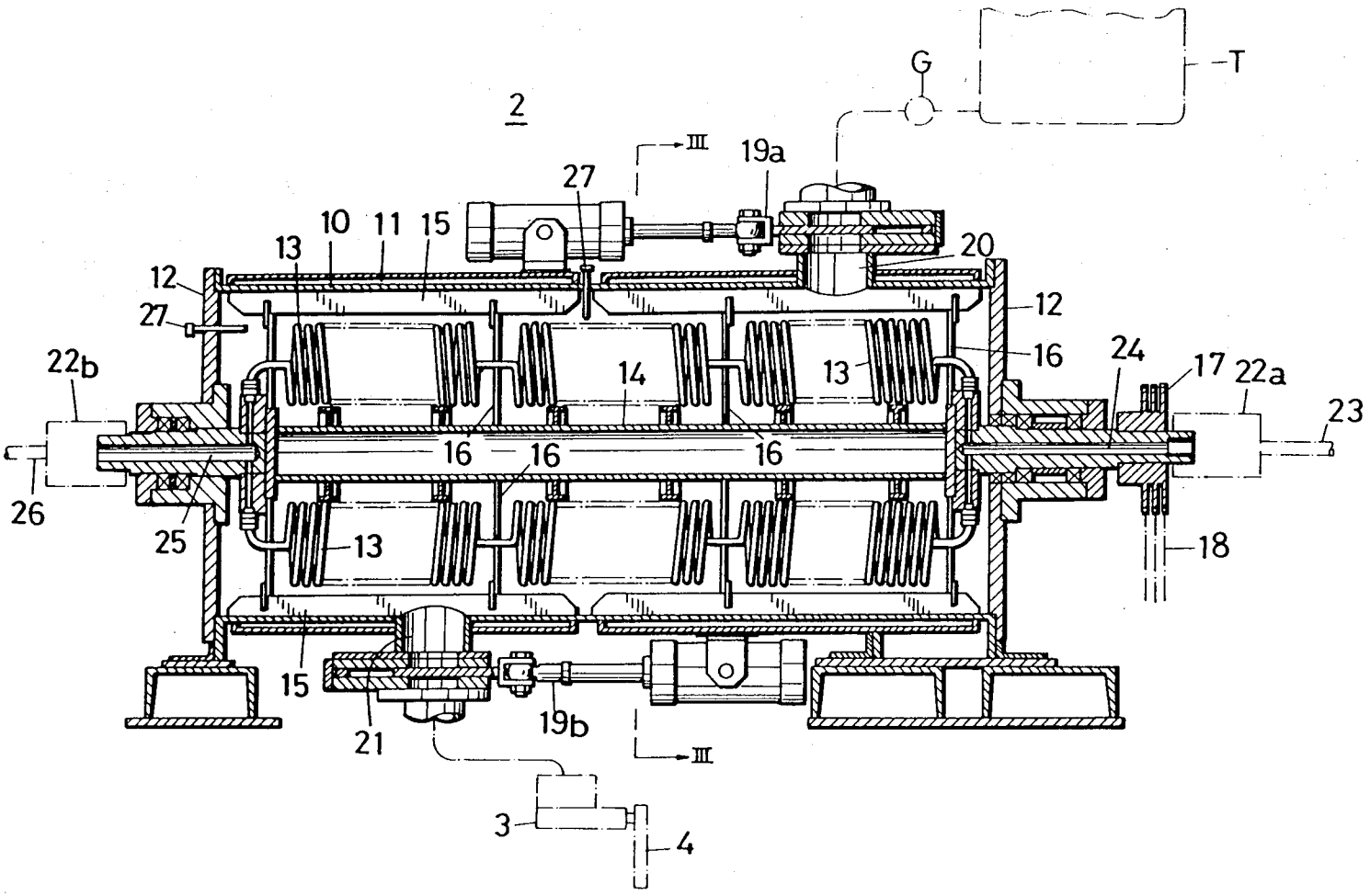
FIG. 2 is a longitudinal sectional view of a precooling device.
Figure 3:
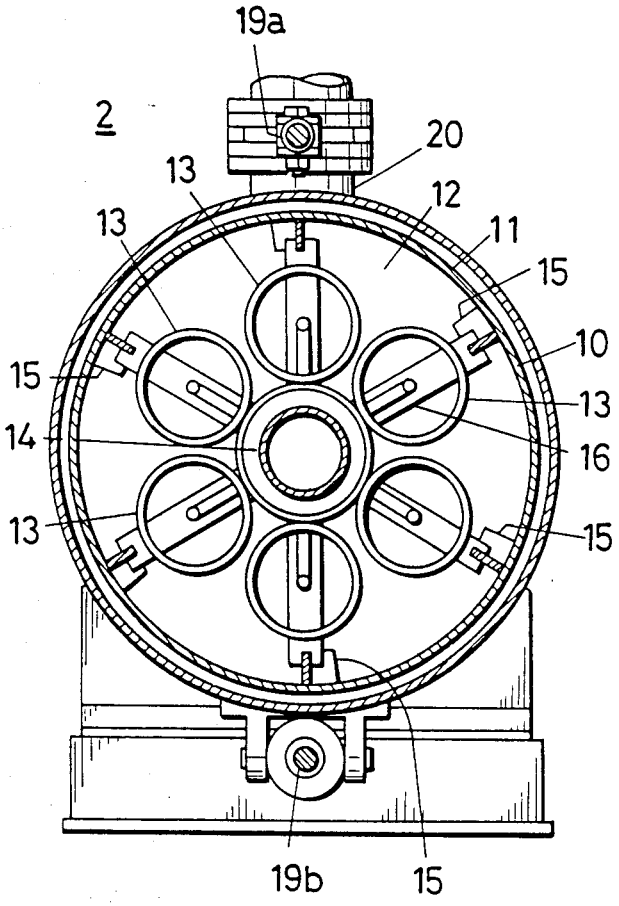
FIG. 3 is a sectional view, taken along the line III—III in FIG. 2.

As shown in FIG. 2 and FIG. 3, the precooling device 2 is placed in a substantially horizontal state and is provided with a tubular body 10 to receive high temperature molten fillers therein. The tubular body 10 has a cooling water jacket 11 at its outer circumference and is closed at its both ends with flanges 12, 12. A plurality (six in the drawing) of spiral pipes 13 are arranged concentrically in the tubular body 10. These spiral pipes 13 are fitted to a shaft 14 inserted in the center of the tubular body 10. The tubular body 10 is provided with rubbing plates 15 which rub the inner circumferential surface of the tubular body 10. The rubbing plate 15 is fitted to the shaft 14 through the medium of a support bar 16. In the drawings, numeral 17 denotes a sprocket wheel fitted to one end of the shaft 14. Numeral 18 notes a driving chain to be driven by a driving motor M1 (FIG. 1) and put on the sprocket wheel 17. Numerals 19*a* and 19*b* denote gate valves to be fitted to an inlet 20 and an outlet 21 respectively of the tubular body 10. Numerals 22*a* and 22*b* denote swivel joints fitted to both ends of the shaft 14. Cooling water is supplied to the spiral pipe 13 from a supply pipe 23 via a supply hole 24 made in one end of the shaft 14. Warm water heat-exchanged in the spiral pipes 13 is introduced into a drain pipe 26 via a drain hole 25 made in the other end of the shaft 14. Numeral 27 denotes a temperature sensor which is inserted in the tubular body 10 at several places for detecting the temperature of fillers in the tubular body 10. The precooling device 2 is stopped at the end of the filling operation and when re-starting, hot water is passed through the jacket 11 and in the spiral pipes 13 so as to drain the remaining filler by heating it to lower its viscosity. Where necessary, a heater can be provided at the outer side of the jacket 11 to heat the jacket. Gate valves 19*a*, 19*b* to be provided at the inlet and at the outlet respectively should preferably be provided with a heater.

A weighing and delivering device 3 is shown in FIG. 4 to FIG. 8.

The weighing and delivering device 3 is provided with a hopper 30 in which fillers are received and a weighing and delivering mechanism 32 under the hopper 30.

A heat insulating means 31, such as a warm water jacket, a heater or the like, is arranged at the outer circumference of the hopper 30. The weighing and delivering mechanism 32 comprises a cylinder 33 which is moved reciprocally, a piston 34 in the cylinder 33 and a slide valve 35 which opens and shuts a supply side to a connecting pipe 36 which is connected to the filling valve 4. The cylinder 33 and the piston 34 are connected respectively to piston rods 37*a* and 38*a* of cylinders 37, 38 for operation and are fitted in such a fashion that they reciprocate in relation to the slide valve 35. Numeral 39 is a hole in communication with slide valve 35 in which a forward end of the cylinder 33 is fitted.

It is so set that when the cylinder 33 is in the advanced position and the piston 34 is in the retreated position (FIG. 5), the capacity S in the cylinder 33 corresponds to the required supply quantity (for example, 10 kg). The cylinder 33 enters and leaves in relation to the bottom opening of the hopper 30.

Figure 6:
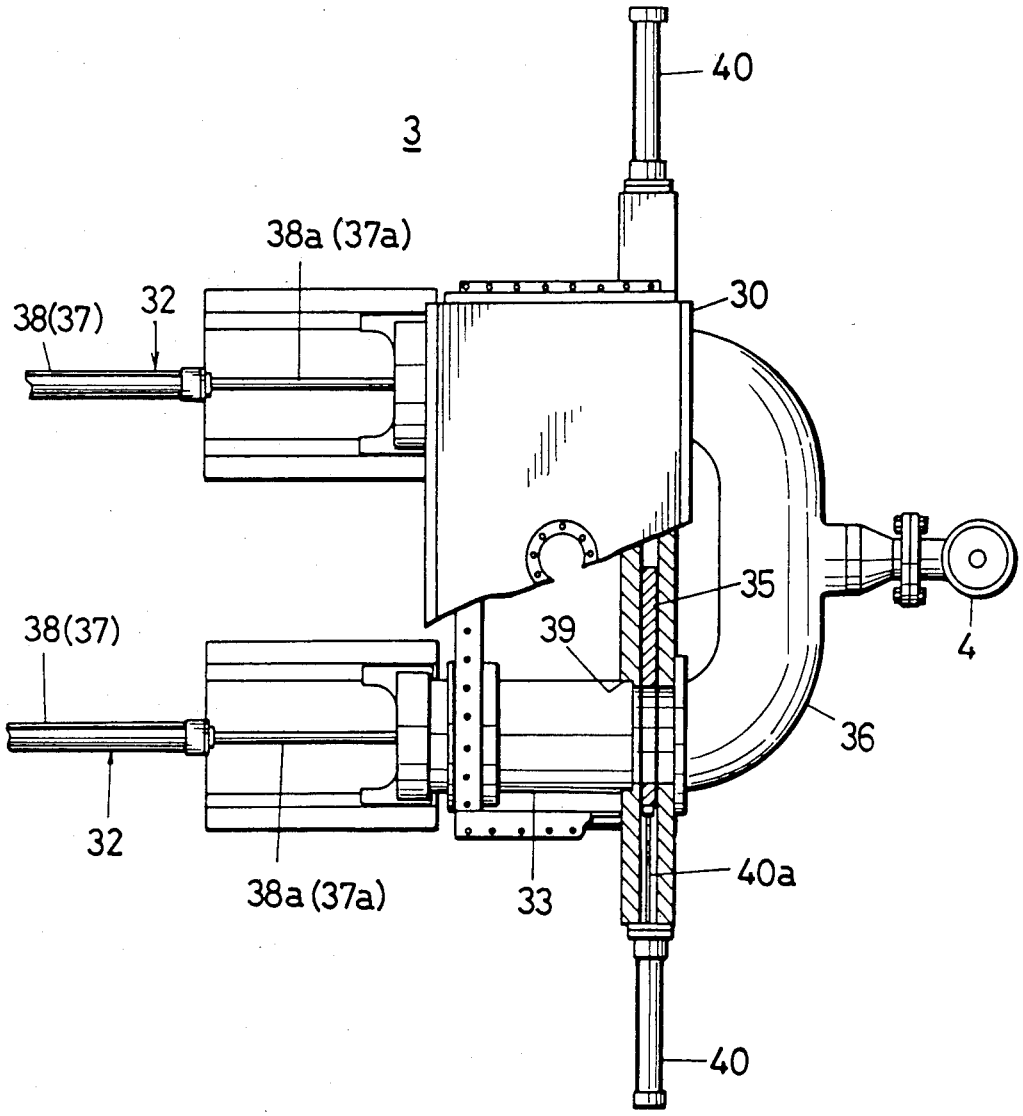
FIG. 6 is a plan view of the weighing and delivering device, partly cut away.
Figure 7:
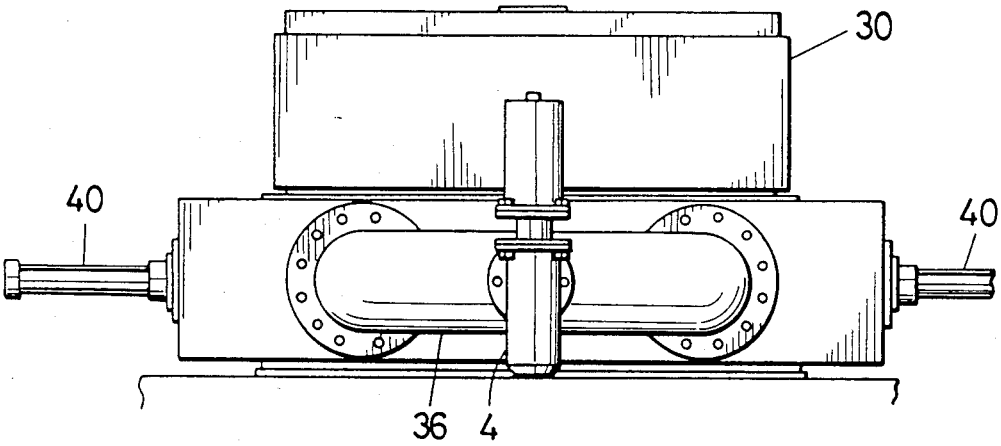
FIG. 7 is a right side view of the device shown in FIG. 4.
Figure 8:
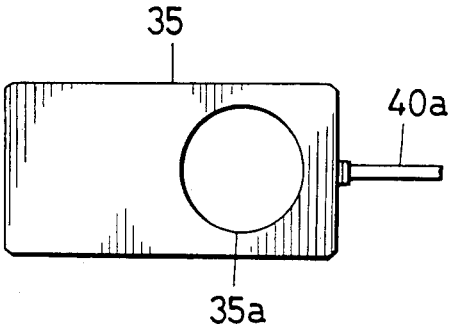
FIG. 8 is a plan view of a slide valve.

As shown in FIG. 8, the slide valve 35 has a communicating hole 35*a* at one side and is connected to a piston rod 40*a* of a piston 40 for operation, whereby opening and shutting a passage to a connecting pipe 36. In FIG. 6, two weighing and delivering mechanisms 32, 32 are arranged below the hopper 30 but one mechanism will do.

Figure 4:
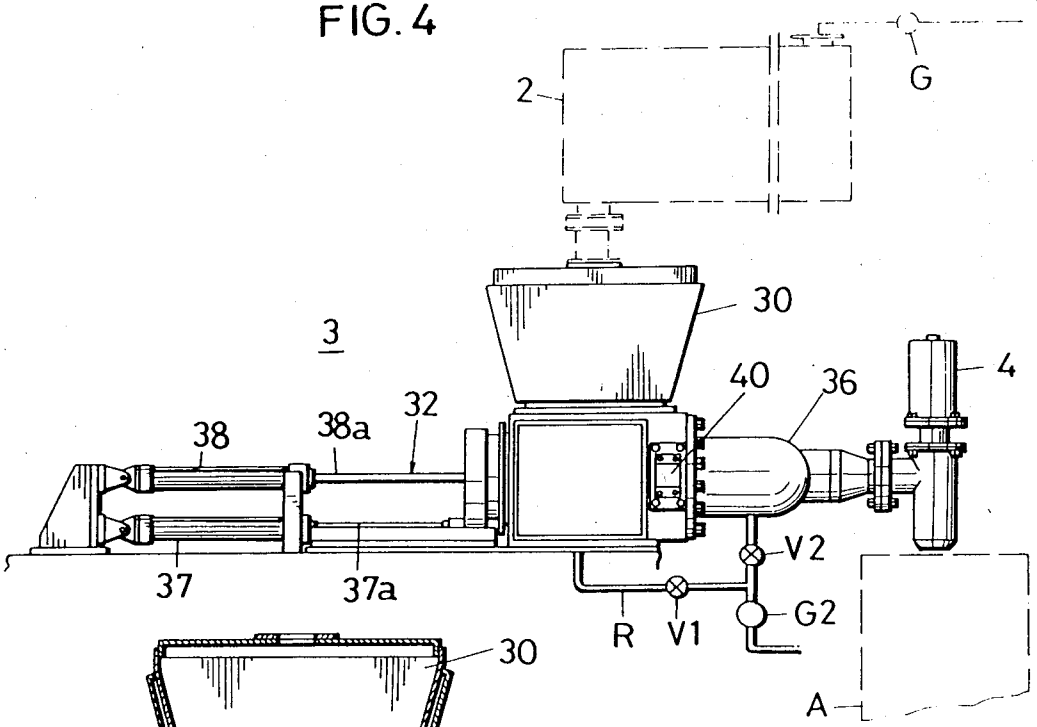
FIG. 4 is an elevational view of the whole of a weighing and delivering device.
Figure 5:
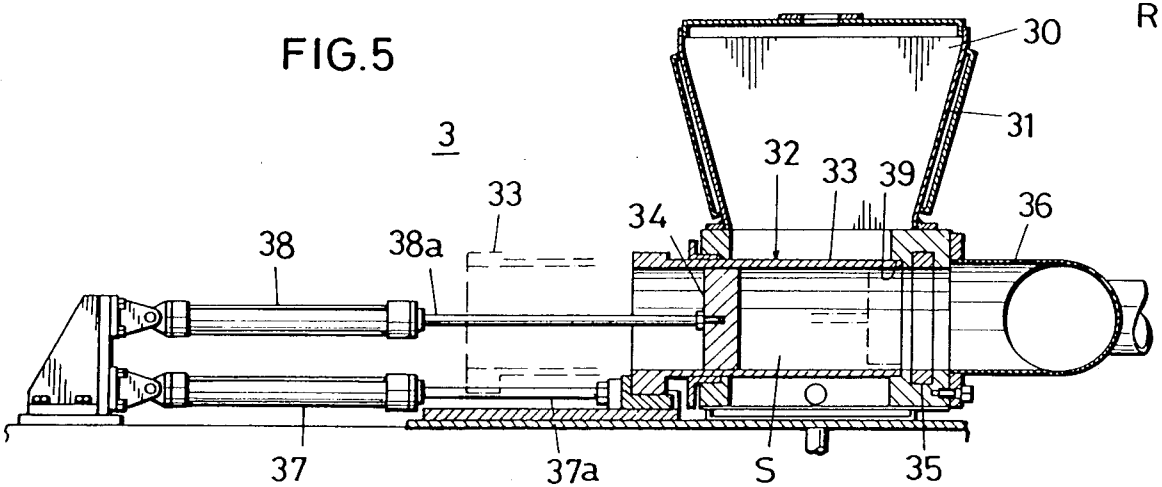
FIG. 5 is a longitudinal sectional view of the weighing and delivering device shown in FIG. 4.

Under the above arrangement, the cylinder 33 and the piston 34 are put back to the position of chain line 33' and to the position of solid line respectively, the slide valve 35 is located in the closed position, and fillers in the hopper 30 are packed to the lower part of the hopper 30. By advancing the cylinder 33, fillers of the required quantity are removed by the cylinder 33 and weighed. Then, by opening the slide valve 35 while the forward end of the cylinder 33 is fitted in the fitting hole 39 and by advancing the piston 34, fillers of the required quantity are sent out into a filling valve 4. In this case, two weighing and delivering mechanisms 32, 32 may be operated alternately but in order to save time required for filling, it is preferable to operate both mechanisms simultaneously. In FIG. 4, R is a return pipe line provided for taking out fillers remaining in the connecting pipe 36 at the end of operation. VI and V2 are change-over valves provided in the pipe line R and G2 is a gear pump for returning fillers to hopper 30.

Figure 9:
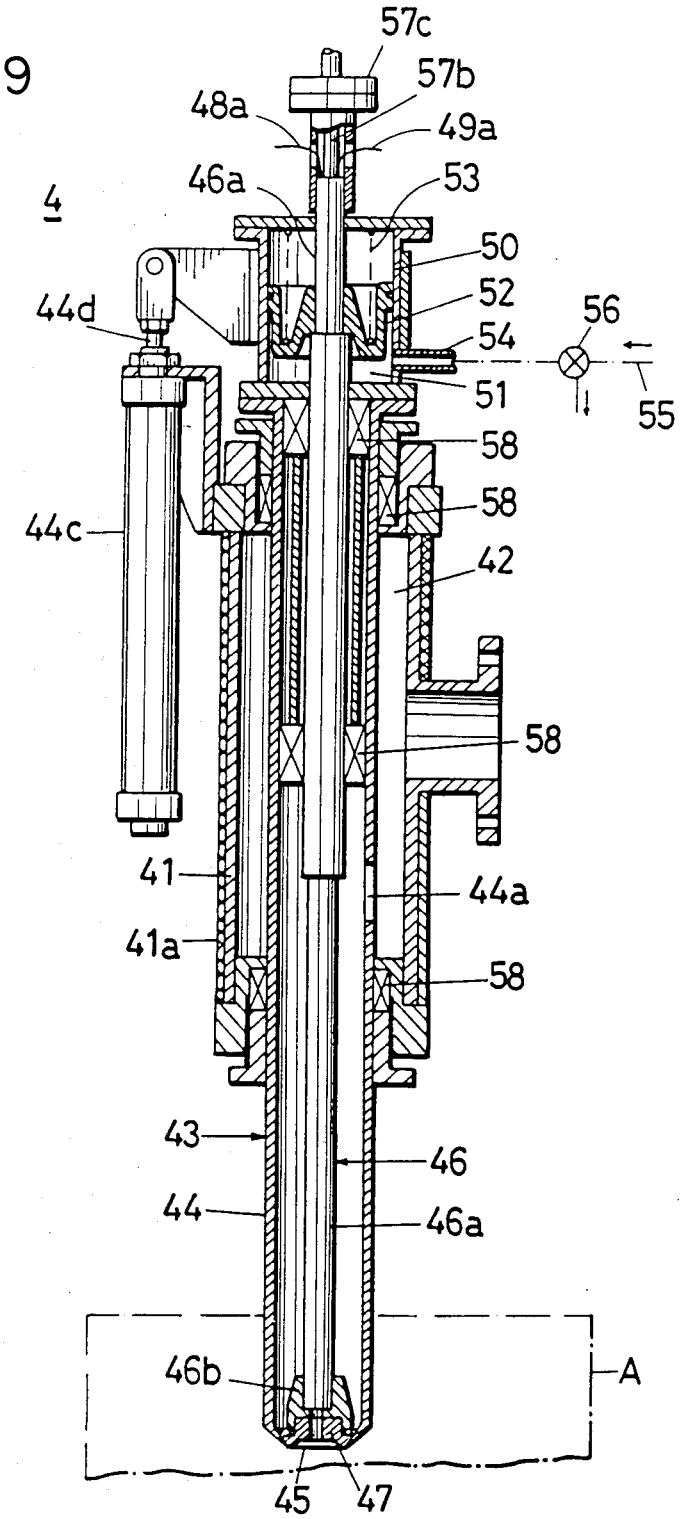
FIG. 9 is a longitudinal sectional view of the whole of a filling valve.

The filling valve 4 makes it possible for a filling nozzle 43 to rise and fall in relation to a packing bag A and is provided with a roping cutting means 57 to prevent fillers adhered to an outlet 45 or thereabouts from roping down in yarn state at closing of the nozzle. As shown in FIG. 9, the filling valve 4 has a filler flow passage 42 in a tubular casing 41, through which the nozzle 43 passes. The casing 41 is covered with a warmth keeping mechanism 41*a*, which is composed of, for example, nickel chrome wire wound round or a surface heating element.

The nozzle 43 comprises mainly a nozzle tubular body 44 having the outlet 45 and a valve body 46 to be inserted in the tubular body 44. A communicating hole 44*a* which lets the flow passage 42 communicate with the inside of the tubular body 44 is made in the nozzle tubular body 44. The tubular body 44 is connected to a piston rod 44*d* of a cylinder 44*c* for raising and lowering nozzle 43, which is fitted to the casing 41. The nozzle 43 is raised and lowered by the working of the cylinder 44*c*.

The valve body 46 is provided with a support pipe 46*a* to be inserted slidably in the tubular body 44, a fitting bracket 46*b* to be fitted to the lower end of the support pipe 46*a* and a valve main body 47 to be fixed to the fitting bracket 46*b* by a fitting screw 46*c*. A tubular member 50 is fitted to the upper part of the casing 41 to form an air chamber 51 between the support pipe 46*a* and the tubular member. The support pipe 46*a* is provided with a valve member 52 which partitions the air chamber 51 into an upper part and a lower part. Provided at the upper part of the valve member 52 is a spring 53 which normally pushes the valve body 46 downwardly, whereby the valve main body 47 is pressed against a valve seat 44*b* formed at the circumferential edge of the outlet 45 of the nozzle tubular body 44. A connecting pipe 54 which introduces pressure air is connected to the lower part of the tubular member 50. By supplying pressure air to the air chamber 51, the valve body 46, together with the valve member 52, rises against pushing force of the spring 53, whereby the valve main body 47 parts from the valve seat 44*b* and fillers are exhausted from the outlet 45 and are supplied to the packing bag A. Numeral 56 is a changeover valve provided at a pressure air supply circuit 55 connected to the connecting pipe 54.

Figure 10:
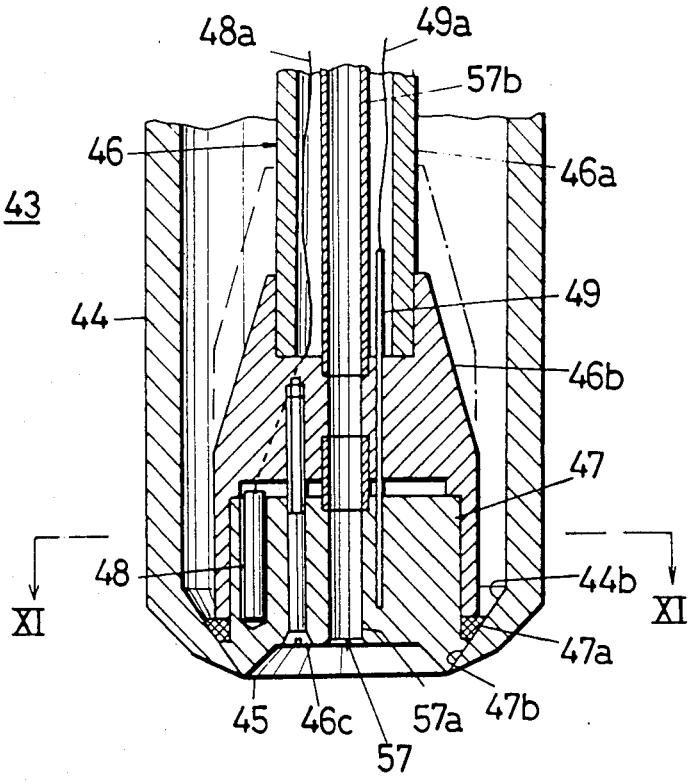
FIG. 10 is a longitudinal sectional view of the lower part of a nozzle, on an enlarged scale.
Figure 11:
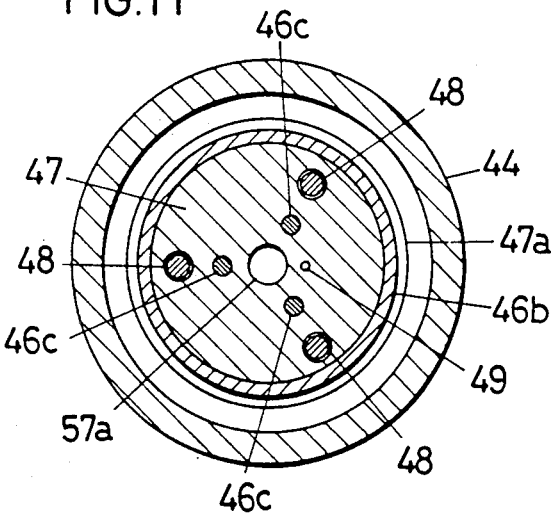
FIG. 11 is a cross section, taken along the line XI—XI in FIG. 10.
Figure 12:
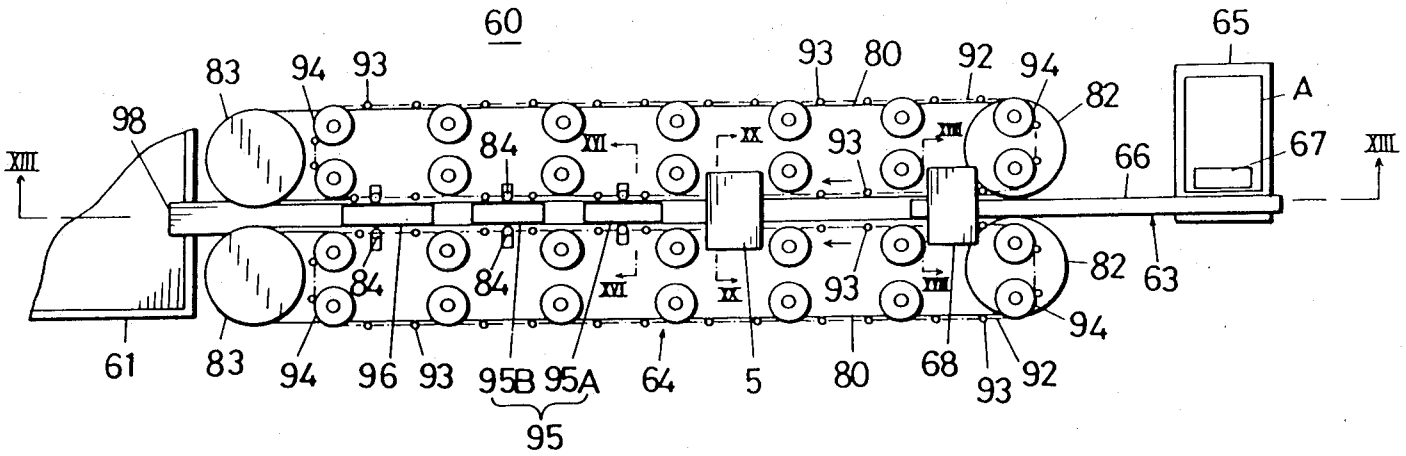
FIG. 12 is a schematic plan view of the whole of a bag supplying and transporting means.
Figure 13:
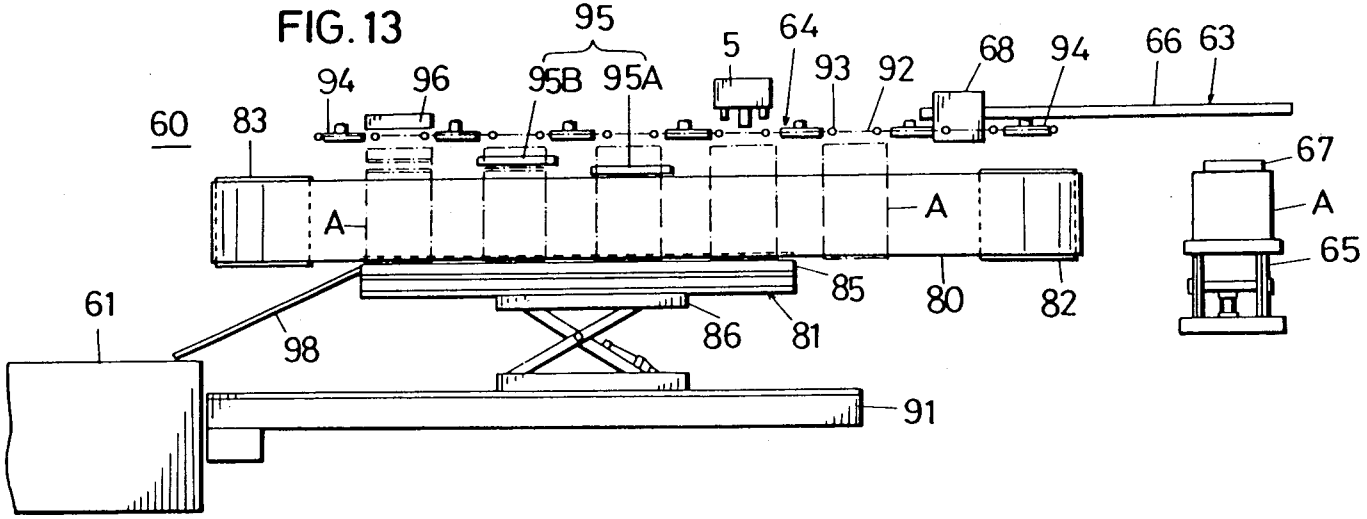
FIG. 13 is a cross section, taken along the line XIII—XIII in FIG. 12.

As shown in FIG. 10, the valve main body 47 is provided with a contacting part 47*b* which contacts the valve seat 44*b*, a proper heating member 48, such as an electric heater, and a sensor 49 for measuring the temperature. Numerals 48*a* and 49*a* are lead wires for the heating member 48 and the sensor 49 respectively. Under the above arrangement, the valve main body 47 is kept at a temperature which maintains fluidity of fillers, for example, at which 130° C. in the case of asphalt. The temperature control is effected by the sensor 49.

As mentioned hereinbefore, the filling valve 4 is provided with the roping cutting means 57 to prevent fillers from roping down at closing of the valve. The roping cutting means 57 prevents roping down of fillers by jetting pressure air from the outlet 45 at all times. This means comprises an air jetting hole 57*a* made through the center of the valve main body 47, an air supply pipe 57*b* connected to the air jetting hole 57*a* and inserted through the support pipe 46*a* and a connecting mechanism 57*c* which connects the air supply pipe 57*b* with a proper pressure air supply source (not shown in the drawings). Air pressure jetted from the air jetting hole 57*a* should preferably be low comparatively. According to the result of experiments carried out, the air pressure of about 0.5 kg/cm$^2$ is proper. If the air pressure is too high, there is a possibility that fillers exhausted from the outlet 45 would be scattered in all directions. Due to this jetting of air pressure, when the outlet 45 is closed semisolid fillers which rope down in yarn state from the outlet 45 are cooled and solidified or loose their fluidity and are blown off by jetting air pressure. The pressure air may be jetted out only at the time of closing the valve, while suspending jetting at the other time. In the drawings, numeral 47*a* is an elastic packing to be provided at the upper part of the contacting part 47*b*. Numeral 58 is a packing for preventing liquid leakage.

The filling valve 4 is also provided with an air blowing-in pipe (FIG. 20 and FIG. 21) for inflating a packing bag A before filling, as a part of a filling means 5 which is explained hereinafter.

The packing device 1 is further provided with a bag supplying and transporting means 60, a cooling water tank 61 for cooling bags A packed with fillers and a removal means 62 to take out cooled bags A from the tank 61.

Figure 15:
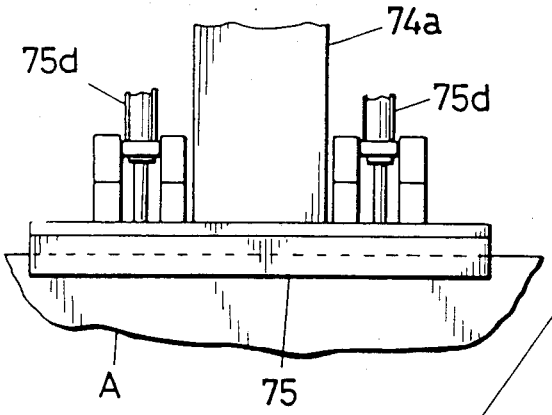
FIG. 15 is a perspective view, taken along the line XV—XV in FIG. 14.

The bag supplying and transporting means 60 is shown in FIG. 12–FIG. 27. This means 60 comprises a bags supplying means 63 and a transporting means 64. The bag supplying means 63 is provided with a bag supplying table 65 on which packing bags A are mounted, an upper conveyor 66 with its one end arranged above the bag supplying table 65 and connecting to an end portion of the transporting means 64, a bag removal device 67 which removes packing bags A one by one from the bag supplying table 65 and delivers them to the upper conveyor 66 and a bag fitting device 68 which opens packing bags A transported by the upper conveyor 66 and delivers them to the transporting means 64. The upper conveyor 66 uses a rodless cylinder, chains for transportion, etc. (not shown in the drawings). Details of the bag removal device 67 are shown in FIG. 14 and FIG. 15.

The bag removal device 67 is provided with a support table 70 fixed to a main axis 69 supported rotatably by a bracket arranged at a proper space (not shown in the drawings) and a driving arm 71. A cylinder for pulling up bags 72 is connected to the support table 70 and a piston rod 71*a* of a cylinder (not shown in the drawings) for rotating the main axis 69 by 90° is connected to a forward end of the driving arm 71. By advancing and retreating of the piston rod 71*a*, the cylinder for pulling up bags 72 is shifted reciprocatively between the vertical position shown by a solid line and the horizontal position shown by a chain line. A bag suction device 73 having a plurality of suction cups 73*a* is fitted to a forward end of a piston rod 72*a* of the cylinder for pulling up bags 72.

Figure 14:
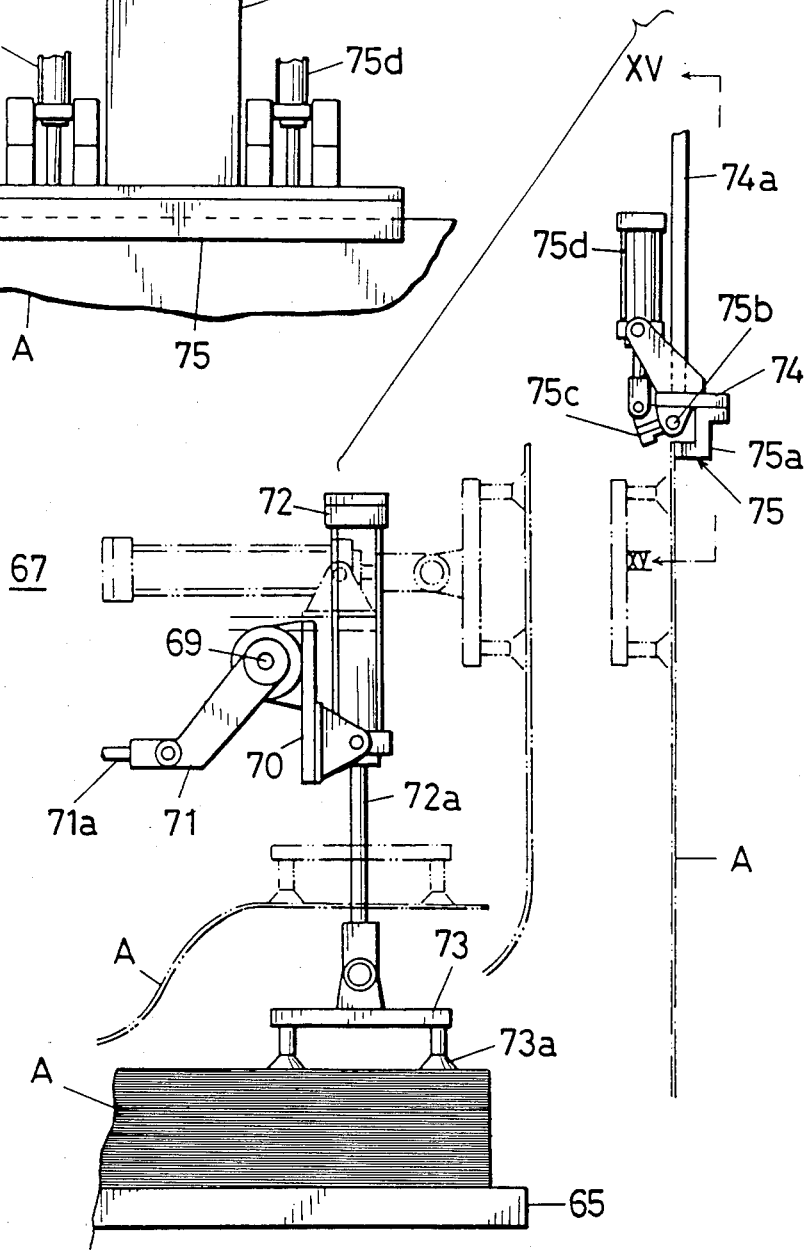
FIG. 14 is a front view of the bag supplying means.

Numeral 74 in FIG. 14 is a sliding table to be hung by a perpendicular arm 74*a* from the conveyor 66. A clip 75 to hold an upper part (opening part) of a bag A is fitted to the sliding table 74. As shown in FIG. 14 and FIG. 15, the clip 75 comprises a pair of movable bars 75*c* fitted rotatably by a fixing bar 75*a* and a pin 75*b* and a pair of cylinders 75*d* for working said movable bars. Details of the bag fitting device 68 will be given hereinafter.

The transporting means 64 is explained below with reference to FIG. 12, FIG. 13 and FIG. 16 to FIG. 21.

The transporting means 64 comprises a pair of endless side belts 80, 80 with a space between the two and a lower support means 81 arranged between and under the two side belts. The side belts 80, 80 should preferably be made of anticorrosive and heat-conductive steel sheet and are stretched by front and rear pulleys 82, 83 (one of them is a driving pulley) in such a fashion that the two side belts move in the direction of arrow simultaneously. The two side belts are held with a fixed space therebetween (100–150 mm., for example) by support rollers 84 arranged at regular intervals.

The lower support means 81 may be an endless belt stretched in horizontal state. In the present invention, as will be mentioned hereinafter, in order to improve the cooling effect on packing bags A transported from the transporting means 64 it is so designed that cooling water is jetted for beneath. Thus, the lower support means 81 is provided with a bottom water tank 85 and a vertically movable table 86 which makes the tank 85 rise and fall. The bottom water tank 85 should have at least a total length which corresponding to the total length from the position at which fillers are packed in a packing bag A to the position at which the packing bag A is released.

Figure 16:
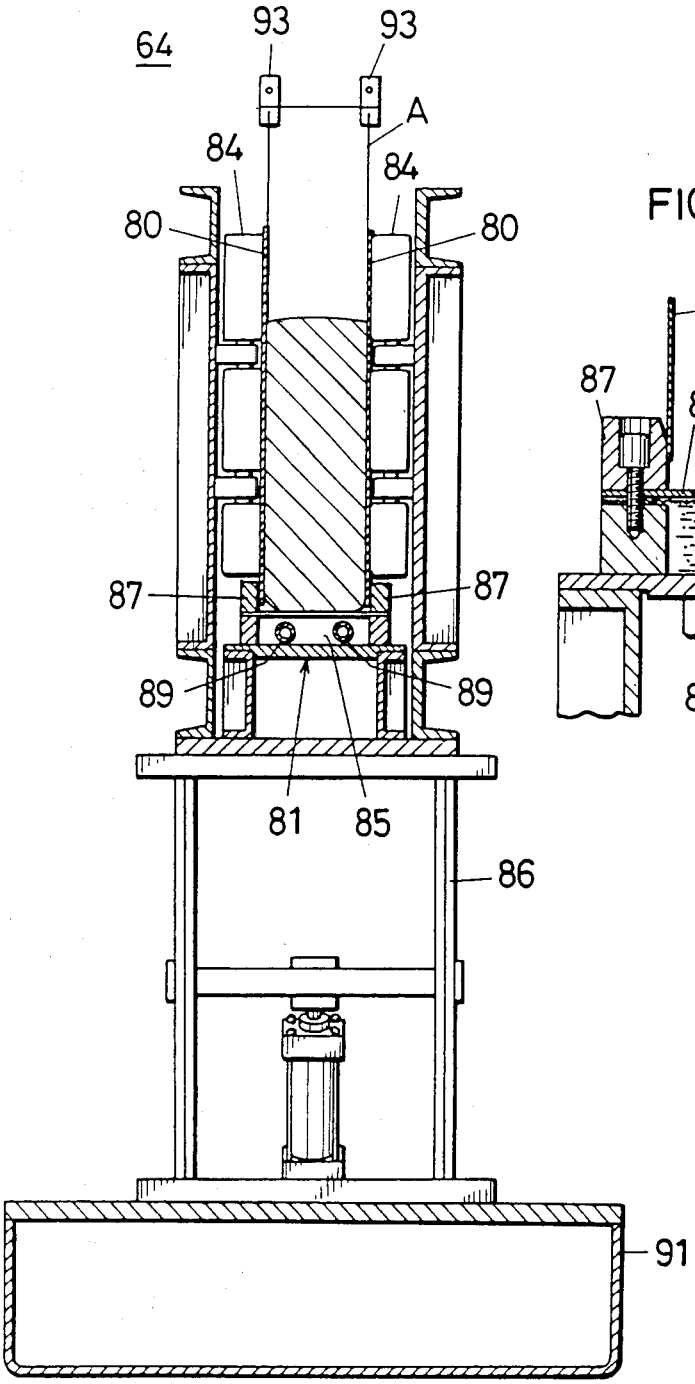
FIG. 16 is a cross section, taken along the line XVI—XVI in FIG. 12.
Figure 17:
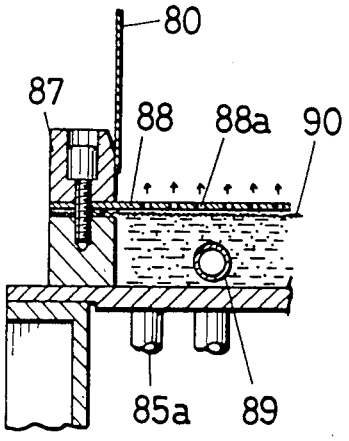
FIG. 17 is a detailed cross section of a bottom water tank.

The upper surface of the water tank 85 is kept pushed up to the desired height. Guide bars 87 are arranged at both lengthwise sides of the tank 85. By these guide bars 87, the lower ends of both side belts 80, 80 are guided and at the time of repairing and cleaning, the vertically movable table 86 is lowered to form a space between the two belts 80, 80 and the table. As shown in FIG. 17, a ceiling plate 88 having many small holes 88*a* is fitted to the upper surface of the tank 85 and a pressure air supplying pipe 89 is inserted in the tank 85, where necessary. This air supplying pipe 89 has many jetting holes through which pressure air is blown into the tank 85. A pressure water supplying pipe 85*a* is connected to the tank 85 and both the cooling water and the pressure air are jetted out through the small holes 88*a* of the ceiling plate 88. Numeral 90 is a wire net fitted to the under surface of the ceiling plate 88. This wire net is effective for distributing uniformly the pressure air to the whole surface of the ceiling plate 88. Numeral 91 in FIG. 16 is a tank to receive therein water which overflowed the tank 85.

The transporting means 64 is further provided with a pair of endless chains 92, 92 arranged in parallel with and above the side belts 80, 80. These endless chains 92, 92 are equipped with clips 93, at regular intervals, each holding removably the open end of a packing bag A. Numeral 94 is a sprocket wheel for stretching the chain 92. The transporting means 64 is still further provided with a sealing means 95 which seals the open end of a packing bag A and a releasing means 96 which releases a packing bag A from the clips 93. Many cooling water jetting nozzles 97 (FIG. 20 and FIG. 21,) which jet cooling water directly on the side belts 80, 80 and hung packing bags A, are arranged between the distance from the position at which the filling valve 4 is installed to the releasing means 96. A cooling means B for packing bags A being transported is composed of the cooling water jetting nozzles 97 and the bottom water tank 85.

In this embodiment, the sealing means 95 is of two-step sealing type (a lower sealing means 95A and an upper sealing means 95B). While the filling valve 4, the lower sealing means 95A, the upper sealing means 95B and the releasing means 96 are fitted at regular intervals, the side belts 80, 80 and the endless chains 92, 92 are moved intermittently by the distance corresponding to the above-mentioned regular intervals (hereinafter referred to as the regular pitch).

Figure 18:
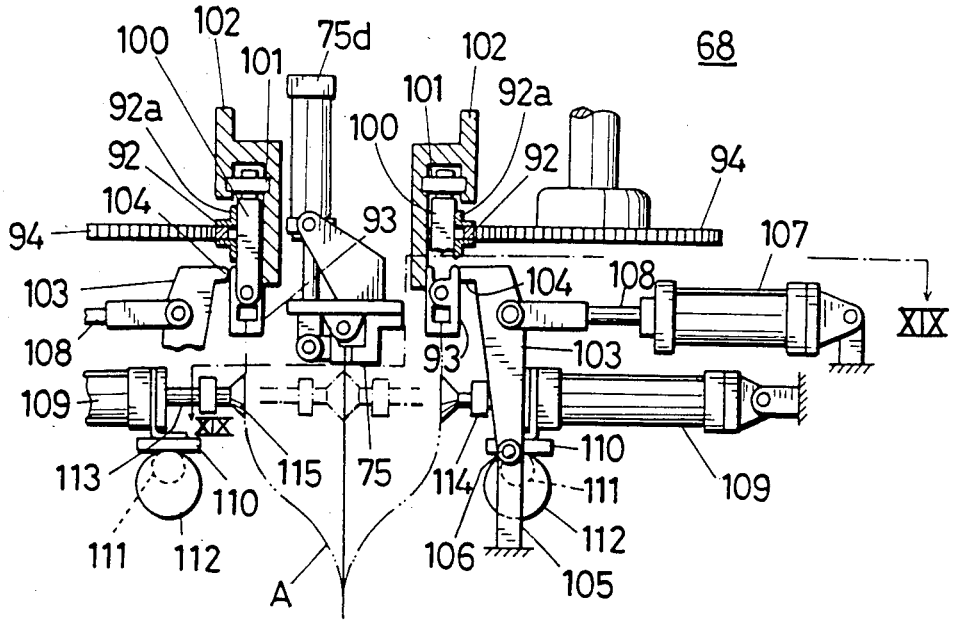
FIG. 18 is a front view of a bag fitting device, taken along the line XVIII - XVIII in FIG. 12.

As shown in FIG. 18, the clip 93 to be attached to the endless chain 92 is fitted to the lower end of a clip holder 100 which is fixed to the endless chain 92 through the medium of an attachment 92*a* and it is so adapted that the lower end is closed by elasticity of a spring (not shown in the drawings). A sliding piece 101 fixed to the upper end of the clip holder 100 is fitted slidably in a chain guide 102 which is arranged along and above the endless chain 92. The inside lever part of the clip 93 slidably contacts a downwardly extended end of the chain guide 102.

A set of four clips 93 is provided for a packing bag A, two each at the left and the right sides of a bag. A releasing means for them is attached to the bag fitting device 68 of the bag supplying means 63. An outline of the bag fitting device 68 and delivery to the clips 93 is given below which reference to FIG. 18 and FIG. 19.

The bag fitting device 68 is provided with a pair of clip pushing levers 103 which are arranged below the endless chain 92 with a space equal to the space between clips 93, 93 therebetween (as both clip pushing levers are the same in construction, explanation is made on only one of them). The clip pushing lever 103 has at its upper end a protrusion 104 which contacts one of the lever parts of the clip 93 and its lower end is supported slidably (left and right) by a pin 106 of a bracket 105. A piston rod 108 of an air cylinder 107 for pushing clips is connected to the clip pushing lever 103 at the position slightly lower than its upper end. By extension of the piston rod 108, a holding part at the lower end of the clip 93 is opened. On the other hand, an air cylinder 109 for opening a packing bag A is provided between and below the air cylinders 107, 107. This air cylinder 109 is supported swingably in vertical direction and a raising and lowering table 110 fixed to a forward end of the cylinder 109 is mounted on a disk-shaped eccentric cam 112 which is fixed to a cam shaft 111. A bag suction device 114 having a plurality of suction cups 115 is fixed to a forward end of a piston rod 113.

Explanation are made below regarding the filling means 5 which is arranged opposite to the transporting means 64, the sealing means 95 and the releasing means 96.

Figure 20:
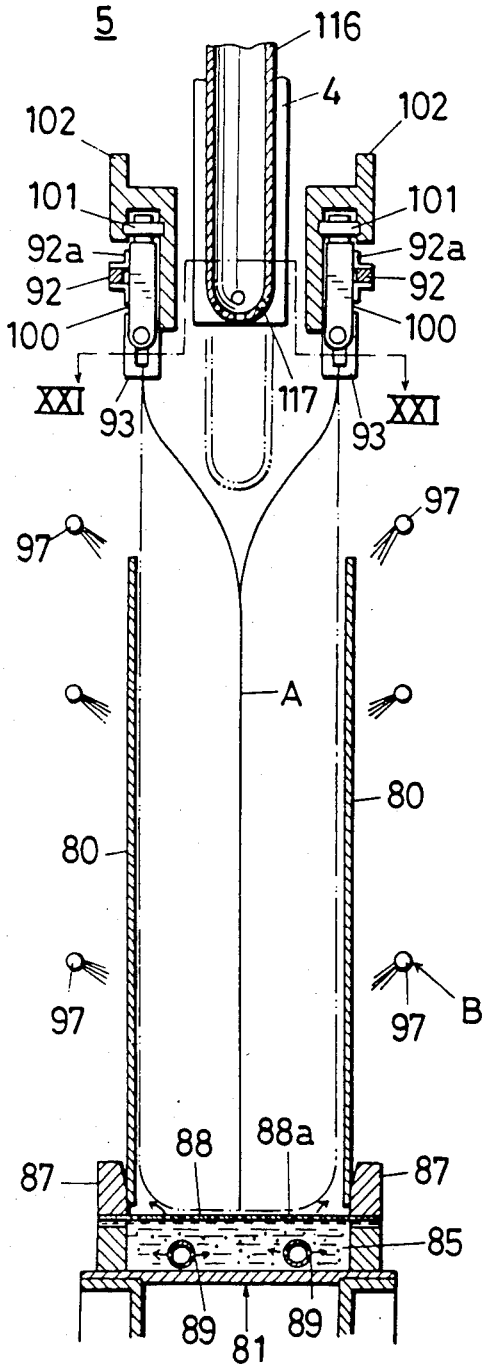
FIG. 20 is a cross section, taken along the line XX—XX in FIG. 12.
Figure 21:
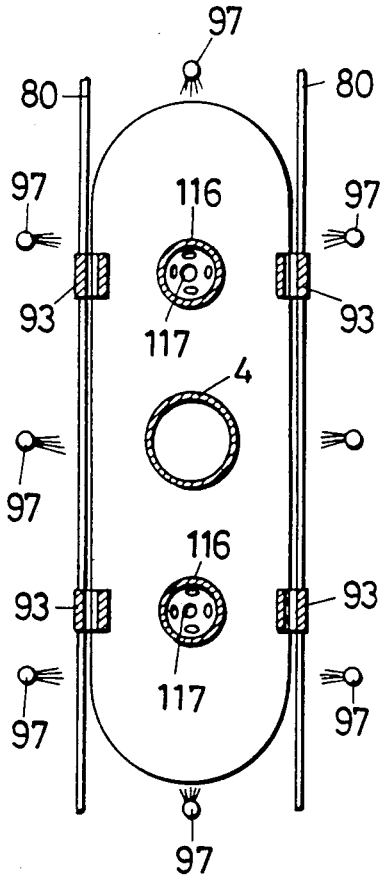
FIG. 21 is a cross section, taken along the line XXI—XXI in FIG. 20.

As shown in FIG. 20 and FIG. 21, the filling means 5 is composed of two air blowing-in pipes 116 which are movable vertically and the filling valve 4 arranged between the pipes 116. The air blowing-in pipe 116 has at its forward end many jetting holes 117 for blowing the air into a packing bag A to inflate it. As shown in FIG. 20, the forward end of the air blowing-in pipe 116 is caused to raise and lower by a proper means from the position shown by a solid line (above the bag A) down to the position shown by a chain line (inside the bag A).

Figure 22:
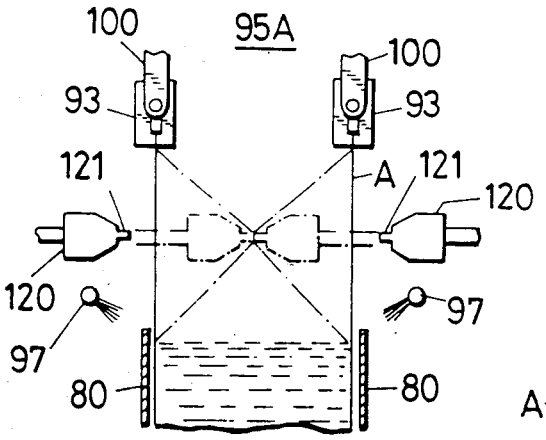
FIG. 22 is an explanatory view of the operation of the lower sealing means.
Figure 23:
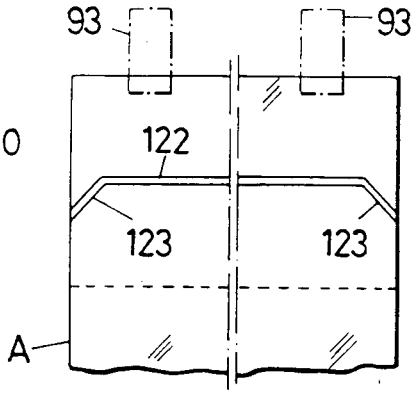
FIG. 23 is a front view of the upper part of a bag with a lower sealing means.

FIG. 22 shows a lower sealing means 95A which heat-seals the neck part of a bag A packed with fillers and is provided with a pair of heating bars 120, 120. This heating bar 120 has a projection 121 and is moved widthwise by a cylinder (not shown in the drawings) at the intermediate part between the upper edge of the side belt 80 and the clip 93. It is desirable to bend both ends of the projection 121 downwardly so as to make both end portions of the lower sealing line 122 slant, as shown in FIG. 23.

Figure 24:
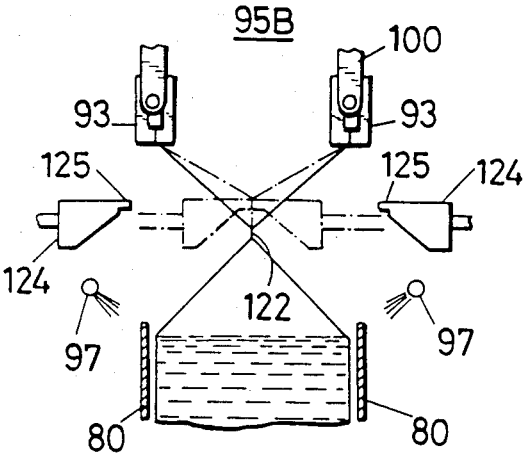
FIG. 24 is an explanatory view of the operation of the upper sealing means.
Figure 25:
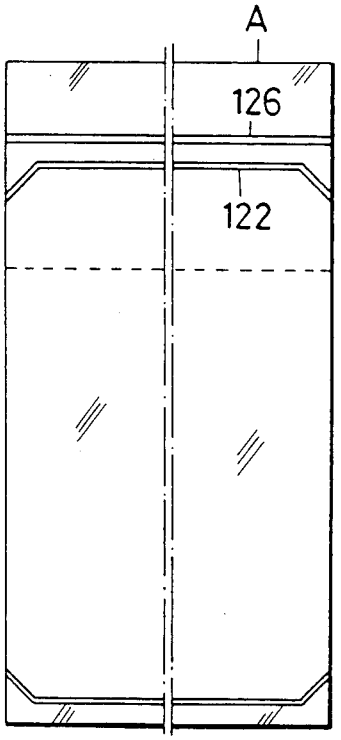
FIG. 25 is a front view of a bag with an upper sealing means.

FIG. 24 shows an upper sealing means 95B. The sealing means 95B is provided with heating bars 124, 124 which are almost the same as those of the sealing means 95A. Each of these heating bars 124, 124 has a protrusion 125 and a straight upper sealing line 126 is formed at the position slightly above the lower sealing means 95A.

Figure 26:
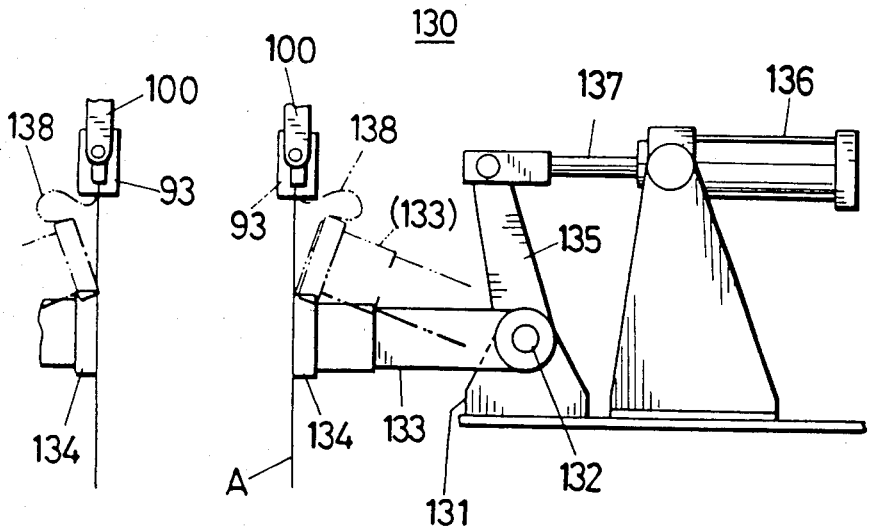
FIG. 26 is an explanatory view of the operation of a loosening device.

In carrying out the sealing operation, it is desirable to make the open end of a packing bag A slightly loose and to prevent the bag from creasing by stretching it laterally. FIG. 26 shows an example of a loosening device 130. The loosening device 130 comprises an axis of rotation 132 supporting by a fixing bracket 131, a support arm 133 having a suction cup 134 at the forward end thereof and a rotary arm 135 with its forward end connected to a piston rod 137 of a cylinder for operation 136 (the latter two are fixed to the axis of rotation 132 at almost a right angle to each other). The support arm 133 rests normally at the position shown by a chain line but when a packing bag A was supplied, the support arm 133 is moved to the position shown by a solid line and the suction cup 134 sticks to the packing bag A. Then, the supporting arm 133 returns to the position by a chain line as it is pulling up the packing bag A and forms loosening 138 at the upper part of the bag A.

Figure 27:
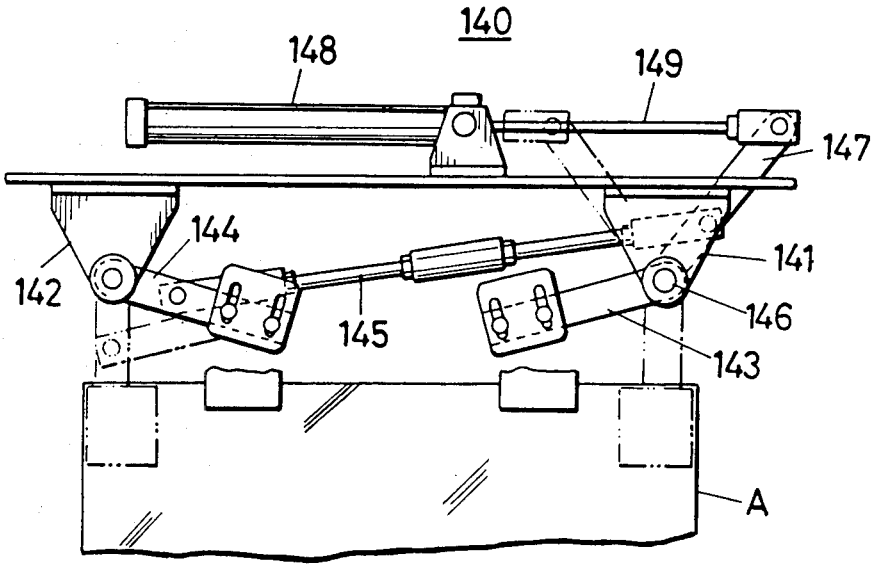
FIG. 27 is an explanatory view of the operation of a pulling device.

FIG. 27 shows an example of a pulling device 140 for preventing creasing of bags. Levers 143, 144 are supported movably by fixing brackets 141, 142 respectively through the medium of an axis. These levers link with each other by a connecting rod 145 and are connected to each other in such a fashion that they turn in opposite direction. An arm 147 is fitted to a support axis 146 to which the lever 143 is fitted and a forward end of the arm 147 is engaged with a piston rod 149 of a cylinder for operation 148. These levers 143, 144 normally rest at the position shown by a solid line but are moved to the position shown by a chain line at the sealing operation, whereby stretching the open end of the packing bag A in breadth direction and preventing creasing of the packing bag.

Figure 19:
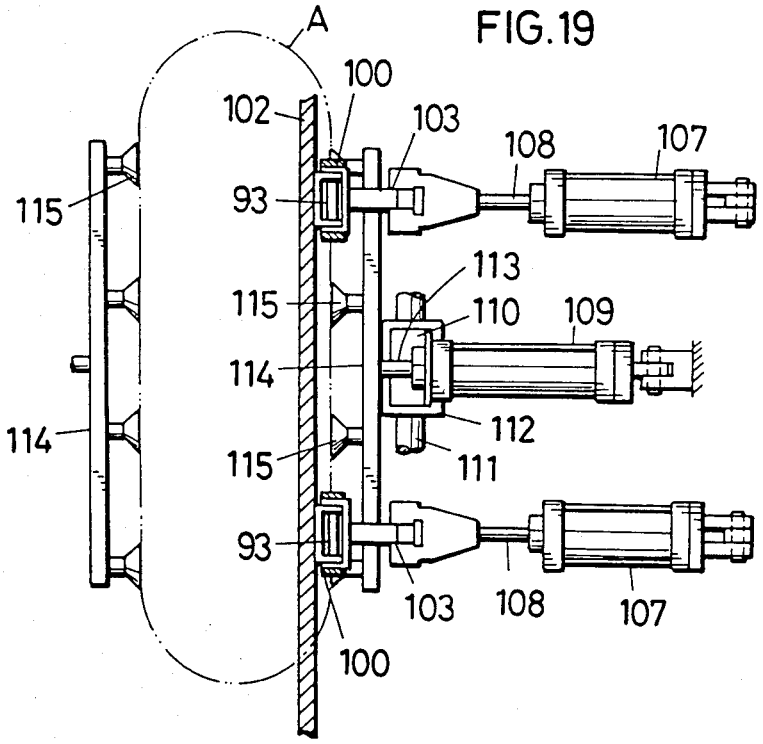
FIG. 19 is a cross section, taken along the line XIX—XIX in FIG. 18.

The releasing means 96 is similar to the clip pushing lever 103, shown in FIG. 18 and FIG. 19, and is operated by an air cylinder. Therefore, explanation of it is omitted.

As shown in FIG. 1, a cooling water tank 61 is partitioned by many partition walls 150 in a zigzag state and the flow of water 151 is formed in the direction of arrow from the side connecting to the transporting means 64 toward the side of a bag removal means 62. Thus, packing bags A put in the process are moved by the flow of water 151 and reach the bag removal means 62 at the other end. In the case of asphalt, for example, its specific gravity is usually 1.0–1.4 but since a bag A packed with asphalt contains water in some quantity, it floats with its sealed upper part upward and is carried by the flow of water, during which it is cooled fully.

The bag removal means 62 is provided with a conveyor 152 whose forward end is inserted in the water tank 61 slantingly, a scraping up arm 153 and a pusher 154 to push scraped up filled bags A toward a transporting conveyor belt 156. The scraping up arm 153 is operated by a detecting means 155 which is arranged at a proper place to detect the arrival of a packing bag A and scrapes up the packing bag A in concert with the rotation of the conveyor 152. In FIG. 1, P represents a wagon for transporting and W shows a piling up means.

In the above-described construction, a molten high temperature semisolid compound is first sent in the tubular body 10 of the precooling device 2, the cooling water jacket 11 and cooling water are circulated and the compound is cooled down uniformly by rotating the spiral pipes 13 to the lowest possible temperature (90° C., for example) at which fluidity of the compound is not lost and is sent into the weighing and delivering device 3. In this device 3, the cylinder 33 which comprises the weighing and delivering mechanism 32 is advanced from the retreated position shown by a chain line and then by advancing the piston 34, the semisolid compound of the required quantity is sent into the filling valve 4.

Layers of packing bags A placed on the bag supplying table 65 of the bag supplying means 63 are taken out, one by one, from the uppermost layer by the bag removal device 67 (refer to FIG. 14), held by the clip 75 provided at the upper conveyor 66 and are delivered to the bag fitting device 68 (refer to FIG. 18 and FIG. 19). In this bag fitting device 68, suction cups 115, 115 on both sides are pushed forward and pressed against both surfaces of a packing bag A by the operation of the air cylinder 109. The suction cup 115 stick to the bag and then the clip 75 of the upper conveyor 66 is released by the operation of the cylinder 75*d*. Then the packing bag A is opened, as shown by a chain line in FIG. 18, by the operation of the air cylinder 109 for opening and the upper edge of the packing bag A is moved right below the clip 93 fitted to the endless chain 92 in standing state. At this time, a movable pawl of the clip 93 is opened beforehand and the upper edge of the packing bag A is pushed in the clip 93 by pushing up the air cylinder 109 by rotating 180° an eccentric cam 112 at the underside of the air cylinder 109. Then, by pulling back the piston rod 108, by the operation of the air cylinder 107 for clip pushing, the packing bag A is held by four clips 93. Then, the endless chain 92 and the side belts 80,80 are moved intermittently, at the same time and at the same speed, and as soon as the packing bag A reaches the filling means 5 and stops, the air blowing-in pipe 116 of the filling means 5 lowers to inflate the bag A by blowing in the air and making both sides of the bag A contact the side belts 80, 80, whereupon the bag A is cooled by cooling water jetted from the cooling water jetting nozzles 97 and from the bottom water tank 85. Then, the air blowing-in pipes are pulled up, the nozzle 43 of the filling valve 4 lowers, and the semisolid compound of the fixed quantity is filled in the bag A. At this time, since the packing bag A has been cooled as mentioned above, the bag A is free from damage even if the softening point of the bag A is somewhat lower than the temperature of the semisolid compound to be filled in. As the packing bag A is held at its both sides by the side belts 80, 80 and is supported at its underside by the supporting means 81, the load of fillers is supported by these side belts 80 and the supporting means 81, applying no load to the packing bag A. Accordingly, the packing bag A is free from bulging due to partial load and consequent damage and thus keeps its shape.

As soon as the backing bag A is packed with a semisolid compound of the fixed quantity, the endless chain 92 and the side belts 80, 80 are driven again and the packing bag A reaches the lower sealing means 95A, where lower sealing 122 (refer to FIG. 23) is effected. In this case, since the filling valve 4 is provided with the roping cutting means to prevent the semisolid compound from roping down at closing of the valve, the opening edge of the packing bag A is free from being stuck with the compound and therefore sealing is effected accurately. Then, the packing bag A is sent to the upper sealing means 95B and the upper sealing line 126 is given at the position slightly above the lower sealing line 122. In carrying out the sealing operation, if the sealing means is combined with the loosening device 130 (in FIG. 26) and the pulling device 140 (in FIG. 27), loosening is formed at the upper part of the packing bag A and the packing bag A is stretched laterally, with the result of accurate sealing effect.

The packing bag A sealed in the above way is released from clips 93 by means of the releasing means 96, slides down a chute 98 into the cooling water tank 61. The cooling water tank 61 is formed in zigzag state by the partition walls 150 and has the flow of water 151 in the direction of arrow. The bag A packed with fillers is cooled down accurately while it floats in tank 61, removed by the bag removal means 62, mounted on the wagon P by the piling up means W and carried out.

According to the present invention, a molten high temperature semisolid compound is precooled to such a temperature at which it maintains viscosity giving no obstacle to the filling operation, packing bags are supplied automatically one by one, the upper edge of the packing bag is opened and the semisolid compound is filled in the bag as it is cooled down by the cooling means. Therefore, the temperature of the semisolid compound to be filled in approaches the softening point temperature of the packing bag. Even if the temperature of the semisolid compound is slightly higher than the softening point temperature of the bag, the bag is free from softening and consequently free from damage. As the filled bag is put in a cooling water tank in which the flow of water is formed, cooling of the bag is carried out effectively. Moreover, as the packing bag is moved in the tank as it is floating, no particular transporting device is required.

In the case where asphalt is used as the semisolid compound, even if asphalt is put in a melting kettle as it is packed in a bag for heating and melting, the bag itself causes no change in the physical property of asphalt. Thus, the present invention dispenses with the trouble of breaking each bag at the time of use and the disposal of emptied bags.

What is claimed is:

1. An apparatus for continuous packing semisolid compound into a bag, comprising:

a bag supplying means for removing synthetic resin bags from a stack of said bags, having an opened end, said bag supplying means including a bag removal device which is caused to remove said bags one-by-one and deliver them with their opened ends upward to transporting means;

said transporting means being for intermittently moving said bags to a position in which said bags are filled with a semisolid compound;

a precooling device for cooling down a molten high temperature semisolid compound to a desired temperature;

a weighing and delivering device for receiving semisolid compound from said precooling device and delivering a predetermined quantity of said semisolid compound to a filling valve;

said filling valve being caused to inject said predetermined quantity of said semisolid compound into said bags one-by-one as said bags are moved by said transporting means;

said supporting means including a pair of endless belts forming a space therebetween for supporting the sides of said bags and a lower supporting means positioned below and between said endless belts for supporting the bottom of said bags;

cooling means positioned along the path of said transporting means for cooling said bags while they are being moved by said transporting means;

heat sealing means positioned along the path of said transporting means for heat sealing said opened end of said bags while they are being moved by said transporting means;

a cooling water tank positioned at one end of said transporting means for cooling said bags after said bags are sealed; and a bag removal means for removing said filled and sealed bags from said water tank and for transporting said bags away from said water tank.

2. The apparatus of claim 1 wherein said precooling device, comprises:

a tubular body for receiving molten semisolid compound having a cooling water jacket around the outer circumference of said tubular body;

a rotary shaft extending through the center of said tubular body;

spiral pipes extending lengthwise inside said tubular body, said spiral pipes being attached to said rotary shaft for rotation therewith inside said tubular body;

at least one scraping plate attached to said rotary shaft for scraping the inner surface of said tubular body when said rotary shaft is rotated;

means for passing cooling water through said spiral pipes while said spiral pipes are caused to rotate by said rotary shaft;

whereby molten semisolid compound, which is supplied to said tubular body, is stirred and cooled uniformly by the combined action of said spiral pipes and said at least one scraping plate.

3. The apparatus of claim 1 wherein said weighing and delivering device, comprises:

a hopper for receiving molten semisolid compound;

a weighing and delivering mechanism positioned at the bottom of said hopper for receiving molten semisolid compound from said hopper and delivering a predetermined quantity of said molten semisolid compound to a filling valve;

a slide valve for opening and closing and exit side of said hopper, said slide valve in communication with said filling valve, a cylinder positioned at the bottom of said hopper, said cylinder being movable towards and away from said slide valve and being connectable with said slide valve for measuring a predetermined quantity of semisolid compound;

a piston slidably positioned in said cylinder, said piston caused to move towards said slide valve for delivering a predetermined quantity of said semisolid compound to said filling valve when said slide valve is in an opened position, said piston caused to move to a retracted position for determining the quantity of molten semisolid compound which is placed in said cylinder by movement of said cylinder away from and towards said slide valve;

whereby accurate weighing and delivering of a predetermined qauntity of said semisolid compound is delivered to said filling valve by the combined action of the cylinder, piston and slide valve.

4. The apparatus of claim 1 wherein, said bag supplying means includes a bag removal device and a bag fitting device for opening and delivering bags to said transporting means;

said bag fitting device having a pair of suction cup members which are caused to contact both sides of the opened end of a bag, said bag fitting device having means to deliver said bags to said transporting means;

said transporting means having a pair of endless chains with clips thereon for holding both sides of the opened end of said bags, and;

said cooling means having spray nozzles for spraying cooling water onto said bags between said endless belts.

5. The apparatus of claim 4 wherein, said lower supporting means includes a bottom water tank and a lift table for raising and lowering said bottom water tank, said bottom water tank having an upper surface, said upper surface being a ceiling plate containing a plurality of small holes, and means for jetting cooling water located beneath said ceiling plate;

whereby cooling water is supplied to the bottom of said bags while they are transported by said transporting means.

6. An apparatus for packing a semisolid compound into a bag as defined in claim 1, wherein the filling valve is provided with a heating member by which said semisolid compound is kept at the required temperature at all times.

7. An apparatus for packing a semisolid compound into a bag as defined in claim 1, wherein the filling valve is further provided with a roping cutting means to prevent semisolid compound from roping down from an outlet of the filling valve when it is closed.

8. An apparatus for packing a semisolid compound into a bag as defined in claim 7, wherein the roping cutting means comprises an air jetting hole provided at the outlet of said filling valve for blowing cooling air upon semisolid compound which is roping down from the outlet at closing of the outlet in order to cool, solidify and cut said semisolid compound off.

9. An apparatus for packing a semisolid compound into a bag as defined in claim 1, wherein the cooling water tank is provided with a flow of water for carrying bags filled with semisolid compound to the side of the bag removal means.

10. An apparatus for packing a semisolid compound into a bag as defined in claim 1, wherein the bag made of synthetic resin is a tubular film with a bottom made by the inflation method by using mixed resin of vinyl acetate copolymer and polyethylene of low density.

* * * * *